US006148575A

United States Patent [19]

Dingler

[11] Patent Number: 6,148,575

[45] Date of Patent: Nov. 21, 2000

[54] STRUCTURAL MEMBER AND PROCESS FOR PRODUCING A STRUCTURAL MEMBER

[76] Inventor: Gerhard Dingler, Schillerstrasse 49, D-72221 Haiterbach, Germany

[21] Appl. No.: 09/214,129

[22] PCT Filed: Jun. 20, 1997

[86] PCT No.: PCT/EP97/03240

§ 371 Date: Feb. 25, 1999

§ 102(e) Date: Feb. 25, 1999

[87] PCT Pub. No.: WO97/49881

PCT Pub. Date: Dec. 31, 1997

[30] Foreign Application Priority Data

Jun. 26, 1996 [DE] Germany ..... 196 25 473
Jun. 12, 1997 [DE] Germany ..... 197 24 701

[51] Int. Cl.[7] ..... E04G 9/05; E04G 1/15

[52] U.S. Cl. ..... 52/309.16; 52/309.15; 52/582.2; 52/630; 52/745.19; 249/189; 249/192

[58] Field of Search ..... 52/309.1, 309.15, 52/309.16, 582.2, 630, 745.19; 249/18, 189, 192

[56] References Cited

U.S. PATENT DOCUMENTS 4,776,556 10/1988 Dingler ..... 52/309.16 X
5,431,366 7/1995 Matsumoto et al. ..... 249/189 X
5,946,878 9/1999 Grund et al. ..... 52/630

FOREIGN PATENT DOCUMENTS 146844 7/1985 European Pat. Off. .
353637 2/1990 European Pat. Off. .
448120 9/1991 European Pat. Off. ..... 249/192
2225989 11/1974 France .
1956308 5/1971 Germany .
2012032 9/1971 Germany ..... 249/189
3804506 8/1989 Germany ..... 249/189
91 00 667 U 2/1992 Germany .
295 13 421 U 11/1995 Germany .
295 06 072 U 12/1995 Germany .
296 17 411 U 12/1996 Germany .
676134 12/1990 Switzerland .

*Primary Examiner*—Laura A. Callo

[57] ABSTRACT

A structural member, in particular for wall and ceiling shuttering, has a working surface and a structural frame on which the working surface is mounted; and frame members perpendicular to the working surface that form the structural frame. The working surface and the structural frame are formed integrally as an injection molded part.

77 Claims, 5 Drawing Sheets

64
48
56
12
66
32
22
24
27
74
73
72
32

STRUCTURAL MEMBER AND PROCESS FOR PRODUCING A STRUCTURAL MEMBER

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

This invention relates to a structural member and a process for producing a structural member with a working surface and a profile frame which supports the working surface.

2. Discussion of Relevant Art

Structural members, in particular, structural members for wall and ceiling shutterings, are already known, and have a shuttering skin of a wooden multilayer panel and a profile frame which is made of steel or aluminum. The profile frames made of aluminum are preferably used for a light construction. In particular, a light construction such as that provided by an aluminum profile frame, as a secondary shuttering, makes rapid work possible without a crane. Fields of use are therefore preferably the building of dwellings, small reconstruction work, and also all fields in which shuttering has to be used without a crane or outside the reach of a crane.

This known shuttering with a wooden multilayer panel entails some disadvantages. Wood is expensive and increasingly less available. Due to a phenolic resin coating and bonding on both sides, such a shuttering skin can give rise to the problem that it is not easily burned. Also, some landfills no longer accept this wood. The shuttering panels have to be nailed and/or screwed in order to connect them to the profile frame. The wood can be mechanically damaged by splintering during nailing.

SUMMARY OF THE INVENTION

Likewise, in the event of damage, a splintering of such wooden shuttering panels can occur on the building site. Moreover, the material is affected by weathering and water uptake. Additionally, a silicone seal is required for the inclusion of the shuttering panels in shuttering frames or profile frames, so that the length changes due to moisture uptake are equalized by the elastic joint. Furthermore, in mechanical cleaning of phenolic resin coated panels, a thickness of up to 440 g per square meter is scraped off, so that an increased use of parting agent is necessary. The impact resulting therefrom on the ground water is considerable.

These objects are achieved according to the invention by a structural member having a working surface, a profile frame that supports the working surface, and is arranged perpendicular to the working surface and has at least one frame member forming the profile frame. The working surface and the profile frame are formed integrally as an injection molded part. These objects also are achieved by a process for the production of the structural member according to the invention, comprising: cutting at least one beam profile and at least one transverse web to size; placing the beam profile and the transverse web arranged thereon in an injection mold; producing in one injection process a structural member having a working surface in a profile frame running on the outside of the working surface and having frame members running perpendicular to the working surface formed by beam profiles that are partially embedded in injection molded plastic. These have a working surface which is made of wood. These working surfaces have, at least on the narrow side, two hook elements with which the scaffold floorings are mounted on the scaffolds. The wooden working surface likewise has the abovementioned disadvantages.

Thermoplastic wastes increasingly arise which are not to be deposited in waste dumps but which are to be reused in the sense of the Recycling Economy Law. Also, the price of new plastic steadily becomes lower, and a supply seems to be insured for several decades, since the ability of the thermoplastic resins to be recycled is initially guaranteed.

The invention therefore has as its object to provide a structural member which makes it possible at least to save wood resources and to use plastic, which itself is recycled or at least recyclable, makes possible a further reduction of the weight of a structural member, and can nevertheless take up the loads corresponding to its end use, and also corresponds in large degree to the method of building heretofore.

The invention furthermore has as its object to provide a process for the production of a structural member which enables the structural member according to the invention to be produced rapidly and inexpensively.

These objects are attained according to the invention by the characterizing features of the claims.

The embodiment of a structural member as an injection molded part has the advantage that a smaller working time is required for its production, so that high labor costs and incidental labor costs can be saved.

This embodiment, particularly for a structural member for wall and floor shuttering and scaffold floorings, furthermore has the advantage that a galvanic pretreatment can be dispensed with, in contrast to the heretofore known profile frames of aluminum or steel. Likewise the expensive coating of such profile frames for use appropriate to a building site can be omitted.

The structural member has the further advantage that the working surface or shuttering panel can be made free from splinters and insensitive to impact, because of the use of a polymer material. The load carrying capacity can remain maintained thereby. The use of polymer materials for the member furthermore leads to a long life being conferred. The polymer materials are more weather resistant and easier to clean than are wood or wooden multilayer panels. For example, the shuttering panel can be easily and quickly cleaned with a steam jet cleaner. The panel is made relatively thin and has practically no thermal inertia. This has the result that, for example when the shuttering panel is sprayed with a steam jet cleaner, differences in longitudinal extension arise between the concrete layer and the plastic, so that the concrete layer comes off from the shuttering panel and the connection is immediately released. The use of suitable polymer materials for the structural member leads to a smaller adhesion of neat cement, and the use of parting agents can therefore be dispensed with.

Such a structural member embodied as an injection molded part has the further advantage that a further weight reduction by about 10% to 20% can be attained with the same dimensions, in contrast to the heretofore known structural members consisting of a metallic profile frame and a multilayer panel of expensive plywood. Handier working, and hence quicker working, can be made possible thereby. This weight reduction is advantageously not at the expense of an increasing concrete pressure or loading, so that just as in the known method of constructing the structural member with a metallic profile frame, for example for shuttering elements, a concrete pressure of up to 60 kN/m$^2$ can be taken up.

The above advantages likewise appear for a structural member which is embodied as a scaffold flooring.

Furthermore, these advantages also result for further structural members which have a working surface and a profile frame, so that additional components can also be provided which are required for special uses.

According to a further advantageous embodiment of the invention, it is provided that the profile frame is formed by frame members which consist at least partially of beam profiles with plastic injected around them. Several elements for a wall shuttering can thereby be securely connected together. These beam profiles can furthermore effect an increase in the rigidity of the members, so that the member is stable against warping and is robust for use on a building site. In particular, the free ends of the profile frame are constituted by an impact resistant polymer material which is insensitive to shocks.

These beam profiles furthermore have the advantage that when used for ceiling shuttering they can be suspended on a drop head or support head and also main and/or auxiliary beams. These beam profiles, advantageously constituted from an aluminum alloy, have the further advantage that the member is insensitive to creep. The polymer materials in general have a very high creep number and have practically no effect in reducing creep stresses. Metals and synthetic resins have a very low creep number, so that creep can be nearly prevented because of the preferred reinforcement which is given by the beam profile. Thus efficient members are constituted which have practically no distortion, even after long use.

The embodiment of a profile frame with a beam profile furthermore has the advantage that such shuttering members can be fully recyclable. Members for which, because of the use of a thermoplastic polymer material a repair no longer appears worth the labor, can be recycled. The beam profiles are operated as an electrical resistance, so that they heat up very strongly and the plastic can be released from the beam profiles. About 90% of the fraction of the beam profile can be released from the plastic by this separation process. The plastic and the fractions of the beam profile only partially still contained therein can be shredded and milled, so that after working up this waste it can be re-used for a member or further metal-plastic structural members for use in the building industry, for example for shuttering panels for ceiling shutterings.

According to a further advantageous embodiment of the invention it is provided that the beam profiles extend along the side surfaces of the profile frame and can be connected together into a beam profile frame by at least one connecting element, such as for example a corner connecting element. The beam profiles can thereby be pre-fixed to each other and securely arranged in an injection mold, so that a positional displacement within the mold due to the high injection pressures can be prevented. Simultaneously, the rigidity of the profile frame can be increased by means of this corner connection, so that again, the rigidity of connection and also the taking up of the concrete pressure can be increased.

According to an further advantageous embodiment of the invention it is provided that in the case of small members, transverse webs are regularly, mutually spaced apart over the length, and can likewise by prefixed to the beam profiles, for example by means of a cramping. For wider members, middle webs can in addition be provided to the beam profiles arranged parallel to the long sides, and can likewise be prefixed to the beam profiles arranged at the ends by means of a cramping, for example. A further stiffening of the profile frame can be attained by means of this embodiment. By the use of profile elements for the transverse and/or middle webs, these can be constituted with a smaller wall thickness than the transverse or middle webs constituted of plastic, so that a weight reduction can thereby be attained, with a simultaneous increase of the rigidity of the profile frame.

According to a further advantageous embodiment of the invention, it is provided that the frame member includes a beam profile which is partially embedded by injection molding, and which has an abutment surface arranged free at an angle to the principal axis of the frame member and has at the free end of the frame member a further internal abutment surface which is not embedded, and a foot, which is not embedded and extends along the principal axis. The remaining portions of the beam profile are substantially embedded by injection molding. These abutment surfaces which are not embedded serve for the arrangement of a shuttering lock in order to connect one or more members together. A claw of the shuttering lock can engage on the abutment surface arranged at an angle to the principal axis of the frame member. The further, inward-facing abutment surface at the end of the frame member can serve for the abutment of a projection in the root region of the claw. The foot which extends free along the principal axis of the frame member makes it possible for the shuttering lock to be braced toward the first abutment surface, so that an alignment of the two elements is possible. This embodiment of the abutment surfaces which are not embedded by injection molding advantageously makes possible a 5-point abutment of the shuttering lock, whereby the concrete pressure of up to 60 kN/m$^2$ can be taken up. At the least, a 3-point abutment is insured, so that a lining up and alignment of the members is made possible.

Furthermore a beam profile is provided according to the invention for the formation of a profile frame of a member for wall and ceiling shutterings, and stiffens the profile frame and makes possible, with a lower, L-shaped foot, a secure reception on main and auxiliary beams, drop heads or support heads. At the same time, an insensitive termination is given by the lower foot. Furthermore, the beam profile has the advantage that an end section is provided on the upper, vertical section of the foot, and can be constituted such that this end section forms a sealed closure in an injection mold, so that the adjoining upper portion of the beam profile can be at least partially embedded by injection molding.

According to a further advantageous embodiment of the invention, it is provided that a claw catch adjoins the end section in the upper section of the beam profile. This has the advantage that a simple arrangement of the corner connecting elements can be provided. These can for example be constituted as a plug connection, which makes possible a secure prefixing of the beam profiles to a beam profile frame.

According to a further advantageous embodiment of the invention, it is provided that two webs arranged substantially in a V-shape to each other are provided in the middle region of the upper section, and serve for the abutment of the free claw ends of a shuttering lock.

According to a further advantageous embodiment of the invention, it is provided that the webs extending left and right of the system plane, the profile webs, V-shaped webs, and the end section, respectively form an abutment surface or support surface in the injection mold. It can thereby be insured that the beam profiles maintain their position in the injection mold during the injection molding process and cannot undergo a disorientation under the influence of the high injection pressure.

According to an advantageous embodiment, it is provided that the member has a prestress which to the greatest possible extent neutralizes the loading provided. There thereby still remain sufficient reserves for the members in order to exhibit the requisite safety and solidity in limit loading cases.

The beam profiles are advantageously positioned, plastically and/or elastically preformed in the mold, during the injection of plastic.

It can also be provided that the beam profiles are plastically preformed, preferably in the direction of the principal axis, and are then placed individually or as a frame into the mold. Alternatively, the beam profile or the frame composed thereby is positioned undeformed in the mold and is deformed by means of a mold control before and/or during the injection molding process. Thus an element can be constituted which has a surface midpoint of the shuttering panel which is at least partially raised with respect to the edge zones. Alternatively, other dome-shaped or curved constitutions of the shuttering panel can be provided according to the specific cases of application and use.

The advantageous embodiments are likewise also applicable, insofar as transferable, for example, for a scaffold flooring, a work platform, to which brackets can be attached, or further structural members which build onto or attach to the structural member according to the invention.

The process for the production of a member for wall and ceiling shutterings has the advantage that an expensive pretreatment and subsequent coating of the profile frame can be saved. Furthermore, by the production of the member in an injection molding process, a considerable number of work steps can be saved such as, for example, the application of a silicone seal in the shuttering frame for receiving a multilayer panel. A considerable cost saving can thereby accrue. At the same time, the production rate can be substantially increased by the production of the member as an injection molded part.

According to a further advantageous embodiment of the process, it is provided that a prefinished shuttering panel, which preferably has a sandwich structure with stiffenings, is placed in the injection mold. The injection molding process can thereby be shortened, and at the same time a firm bonding into an integral member is made possible by the embedding of the inserted parts, such as, for example, a shuttering panel and a beam profile frame, by injection molding.

BRIEF DESCRIPTION OF THE DRAWINGS

The invention will now be described in preferred embodiments, taken together with the drawings, in which.

DETAILED DESCRIPTION OF PREFERRED EMBODIMENTS

Figure 1:
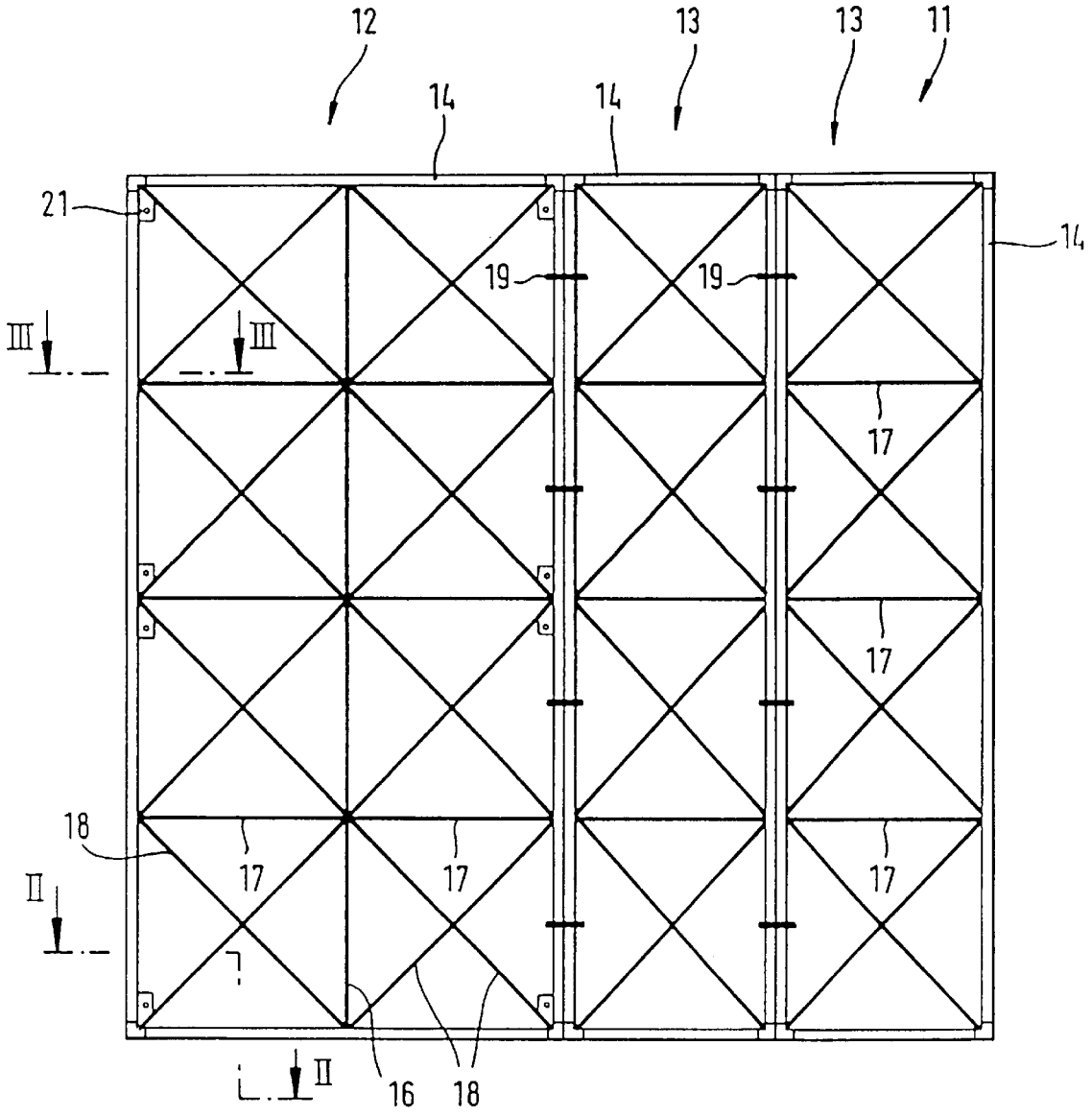
FIG. 1 shows a shuttering consisting of a composite of two shuttering members with shuttering locks.

A composite 11 is shown as a detail in FIG. 1, and consists of three shuttering members 12, 13 which are associated by shuttering locks 19. The shuttering member 12 has a shuttering height of 160 mm and a width of 80 cm. The shuttering member 13 is constituted as a small version, with a shuttering height of 160 cm and a width of 40 cm. The shuttering member 12 has a structural frame 14 which runs around its periphery, and a vertical middle web 16. Horizontal transverse webs 17 extend in the regions between the vertical frame members of the structural frame 14 and the middle web 16. A rib structure 18 is provided in the regions enclosed between the middle web 16 and the transverse webs 17, and is constituted by two ribs situated in the diagonals of the regions. Further embodiments which make possible a stiffening of the regions are likewise conceivable. For example, the height of the rib structure can decrease outward, seen from the surface midpoint of the shuttering panel 22.

The mutually adjacent vertical frame members of the structural frames 14 of the shuttering members 12, 13 are connected by shuttering locks 19, four of which are used here, for example. The shuttering member 13 has a structural frame 14 which runs around its periphery. Transverse webs 17 are formed between the vertical frame members of the structural frame 14, and are arranged at a regular mutual spacing. A rib structure 18 is likewise provided between the transverse webs 17, and is constituted analogously to the shuttering element 12. The structural frames 14 of the shuttering members 12, 13 have an analogous structure with the same material with equal cross section. The shuttering member 12 is connected to the shuttering member 13 by shuttering locks 19. These engage on the frame members of the structural frames 14 and fasten the two adjacent structural frames 14 together. Analogously, the two shuttering members 13 are fastened together, so that a wall of shuttering members can be formed by such an arrangement, the shuttering members 12, 13 being able to be arranged horizontal and/or vertical to each other.

Anchor pockets 21 for the tension bars of shuttering anchors are provided in the regions of the shuttering member 12 between a frame member of the structural frame 14 and a rib structure 18. These anchor pockets 21 are advantageously arranged with respect to the regions of the shuttering member 12 so as to be arranged symmetrically with respect to the longitudinal and transverse axes of the shuttering member 12, so that it is not necessary to consider the alignment of the shuttering panel 12. This likewise holds for the shuttering panels 13.

Figure 2:
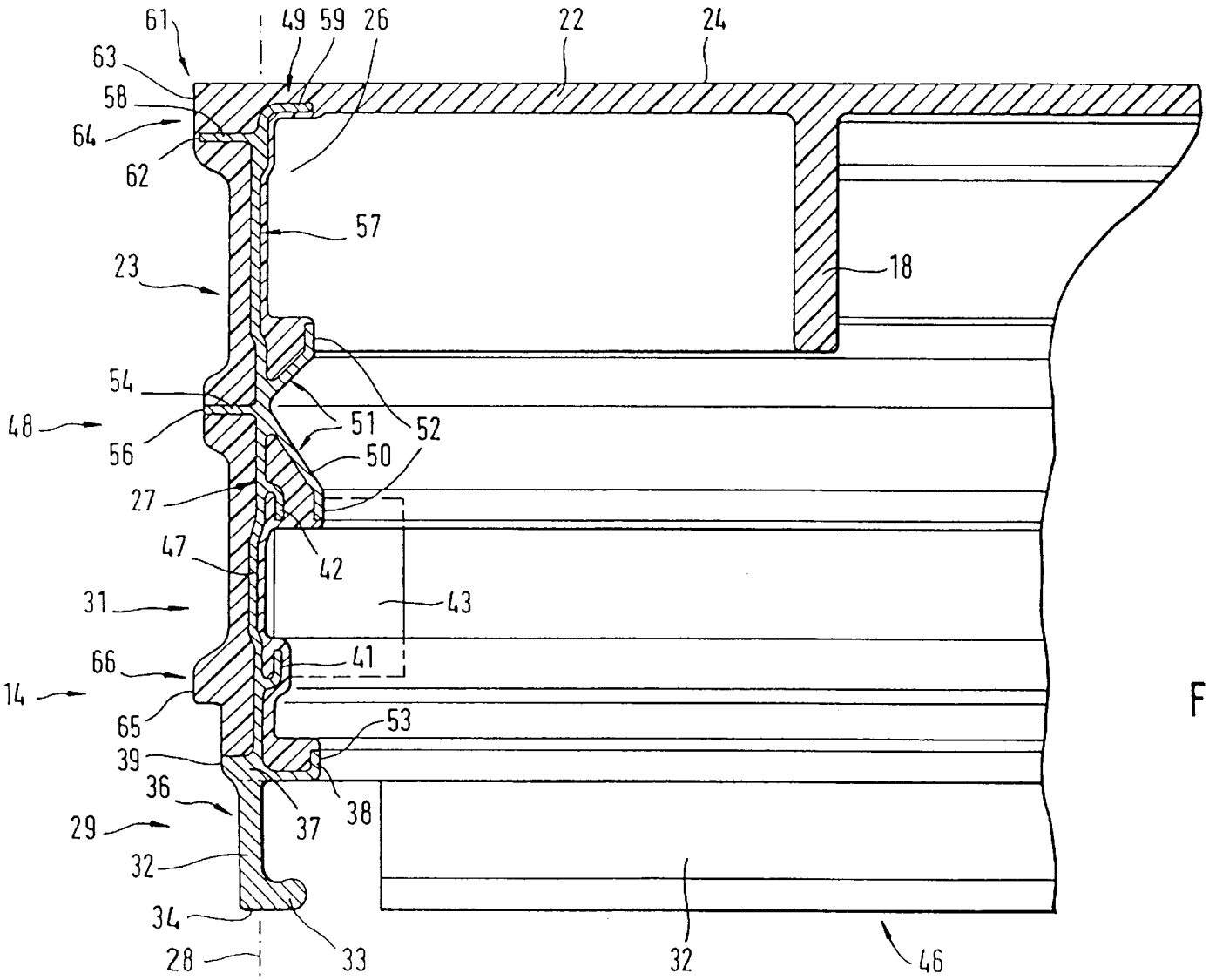
FIG. 2 shows a schematic sectional view along the line II—II in FIG. 1, with a schematic representation of a beam profile.

A schematic cross section along the line II—II in FIG. 1 is shown in FIG. 2. The shuttering panel 12 is shown as an injection molded part, and has a frame member 23 of the structural frame 14 formed by a beam profile 27 with a partial injection molding of plastic around it. The frame member 23 is arranged substantially perpendicular to the shuttering panel 22. The rib structure 18 is arranged at a front side 24 of the shuttering panel 22, against which concrete abuts when poured, in order to make possible a rigid constitution of the shuttering panel 22. The rib structure 18 runs diagonally toward the left in a corner region 26.

The frame member 23 has a system plane 28 along a cross sectional surface of the beam profile 27. The beam profile 27 has a lower section 29 which does not have plastic injected around it, and an upper section with plastic injection molded around it. The lower section 29 is constituted by an L-shaped foot 32, the horizontal section of which faces toward the middle of the shuttering member 12. This L-shaped foot 32 serves for secure arrangement and abutment of the shuttering member 12 on main and auxiliary beams of a frame for ceiling shutterings. The lower abutment surface 34 furthermore serves for the alignment of the shuttering member 12 with respect to a further shuttering member 12 or 13 with a shuttering lock 19. A vertical section 36 of the foot 32 is bounded by an end section 37. The end section 37 separates the lower section 29 having no plastic injected around it from the upper section 31 around which plastic has been injection molded. This end section 37 also serves to close off the injection mold with respect to the foot 32, which projects from the injection mold. The end section has a right-hand arm 38 which is constituted in an L-shape. Provided opposite this is a left-hand projection 39, the height of which corresponds substantially to the wall thickness with which polymer is injected around the beam profile 27 toward the outer side. An inner side of the beam profile 27 is provided with a substantially smaller wall thickness than an outer side. The inner thickness of the plastic layer can be 1–2 mm, for example.

Upper and lower guide grooves 41, 42 have a U-shape and are directed toward each other, adjoining the end section 37 with a spacing, following as viewed upward along the system plane 28. These guide grooves 41, 42 facing toward the middle of the shuttering member 12 serve to receive a corner connecting element 43, in order to fasten together two beam profiles 27 which are arranged at a right angle to each other. The corner connecting element 43 can be constituted as an angle with equal arms, the free ends of which can be pushed into the guide grooves 41, 42. The beam profiles 27 can thereby be mutually arranged to a beam profile frame 46 which forms the structural frame 14 after being at least partially embedded in injection molded plastic. The connection of the beam profiles 27 at the corners is to have a certain stiffness, but it should however also be made possible for the thereby formed beam profile frame 46 to be embodied with resilience, to the extent that a slight alignment and arrangement is still possible on placing the beam profile frame 46 in an injection mold. The corner connecting element 43 can be connectable to the guide grooves 41, 42 by means of a clamp connection, latching connection, snap connection or the like.

The guide grooves 41, 42 have plastic injected around them outside the corner region 26 and serve as a claw catch with the plastic. A better bonding between the plastic and the beam profile 27 can be given thereby. An offset 47 is provided between the guide grooves 41, 42 and is provided for stiffening the beam profile 27. The beam profile 27 has a substantially constant cross section from the end section 37 as far as the end region 49. The wall thickness is about 1.5 mm. Several bores (not shown) are provided in the longitudinal axis of the beam profile 27 in the region of the offset 47. The plastic can reach the inner side from the outer side of the frame member 23 via the bores, and can completely surround the surface between the guide grooves 41, 42.

Two webs 51 arranged in a V-shape to each other are arranged along the system plane 28 above the guide groove 42 in the middle region 48 of the upper section 31, and face toward the middle of the shuttering member 12, with end sections 52 arranged at their free ends, substantially parallel to the system plane 28. The lower web 51 is made larger than the upper web 51. The webs 51 are preferably provided at an angle of about 100° to each other. The lower web 51 is provided, for example, at an angle of about 2545° to the system plane 28. The upper and lower web surfaces 51 are functional surfaces and also an external abutment surface 53 of the right-hand arm 38 of the end section 37. These functional surfaces do not have plastic injection molded around them. The shuttering lock 19 engages on these surfaces 51, 53 and 54. A 5-point abutment can be given by this embodiment, with a claw of the shuttering lock 19 abutting at least on the lower web surface 51 and abutting with a projection in the root region of the claw on the abutment surface 53 and simultaneously makes possible the alignment of the front side 24 of the shuttering skin 22 by two mutually arranged shuttering panels by means of the abutment surface 34. The result is thereby also that the end sections 52 and the abutment surface 53 are provided, running in a plane parallel to the system plane 28.

Polymer material is filled in between the wall section, which runs in the system plane 28, of the beam profile 27, and the lower web 51. This serves to support and stiffen the upper and lower webs 51, which are respectively arranged in V-shape to the wall section. The guide groove 52 also serves as reinforcement or stiffening of the lower web 51.

A web 54 is provided, arranged substantially at right angles to the system plane 28 and facing outward, opposite to, and between, the upper and lower webs 51. Seen in the longitudinal direction, the web 54 is formed with perforations. An end side 56 of the web 54 abuts a mold wall. It is further provided that, when the injection mold is closed, the free end sections 52 abut on an opposing wall section, and can thereby insure that the middle region 48 of the beam profile 27 can be fixed in correct position in the injection mold even under the influence of the high injection pressure.

A further offset 57 is provided between the webs 51 arranged in a V-shape and one end region 49, and again is arranged for stiffening. The end region 49 has two profile webs 58, 59 which face mutually oppositely and which are arranged substantially perpendicularly to the system plane 28. The left-hand profile web 58 forms a stiffening of an edge 61 which is formed between the frame member 23 and the front side 24 of the shuttering panel 22. An end face 62 of the profile web 58 borders directly on an abutment face 63 of the projection 64. The height of the projection 64 corresponds to the height, seen from the system plane 28, of a projection 66 which is arranged opposite the guide groove 41. A substantially linear contact can thus be attained between the upper and lower projections 64, 66 of one shuttering member 12 with the corresponding projections of the further shuttering member. Thus an abutment can be obtained which is insensitive to dirt, insuring that no seam can arise between the two edges 61 of the shuttering member 12.

Bores (not shown) are likewise formed in the region of the offset 57, so that an inner side of the beam profile 27 can have plastic injected around it. The profile web faces in the direction of the shuttering panel 22 and thus forms a secure transition for passing the concrete pressure from the shuttering panel 22 to the frame member 23 of the structural frame 14.

The beam profile 27 is constituted as an extruded profile and preferably consists of aluminum or an aluminum alloy, such as for example $AlMgSi_{0.5}$ or titanium or titanium alloy. Furthermore, further light metals and also metals can be used. Likewise, high strength plastics or fiber-reinforced plastics, for example, plastics reinforced with carbon/Kevlar (fiber), are possible for constituting beam profiles.

It can furthermore be provided that the wall thickness of the beam profile 27 can be increased in order to increase the stiffness. Alternatively, it can likewise be provided that the beam profile 27 is constituted as a hollow profile body with one or more chambers, whereby a further increase in stiffness or torsional strength of a shuttering member 12 can be attained. The beam profile 27 can furthermore be preformed, preferably plastically preformed.

Figure 4:
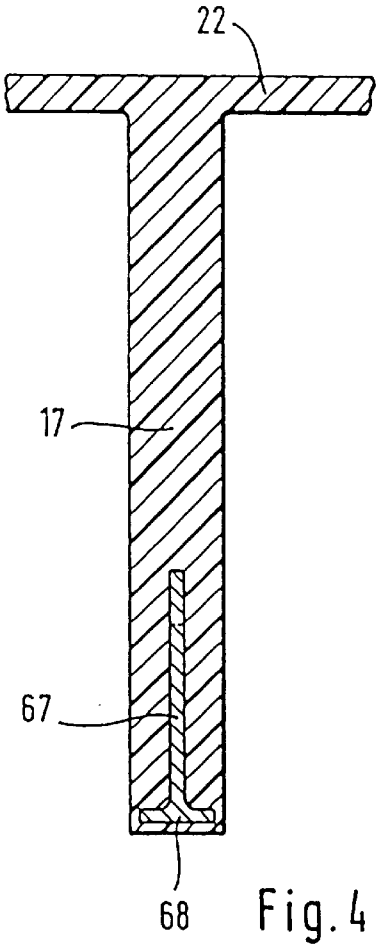
FIG. 4 shows a section of a transverse web along the line IV—IV in FIG. 3.
Figure 3:
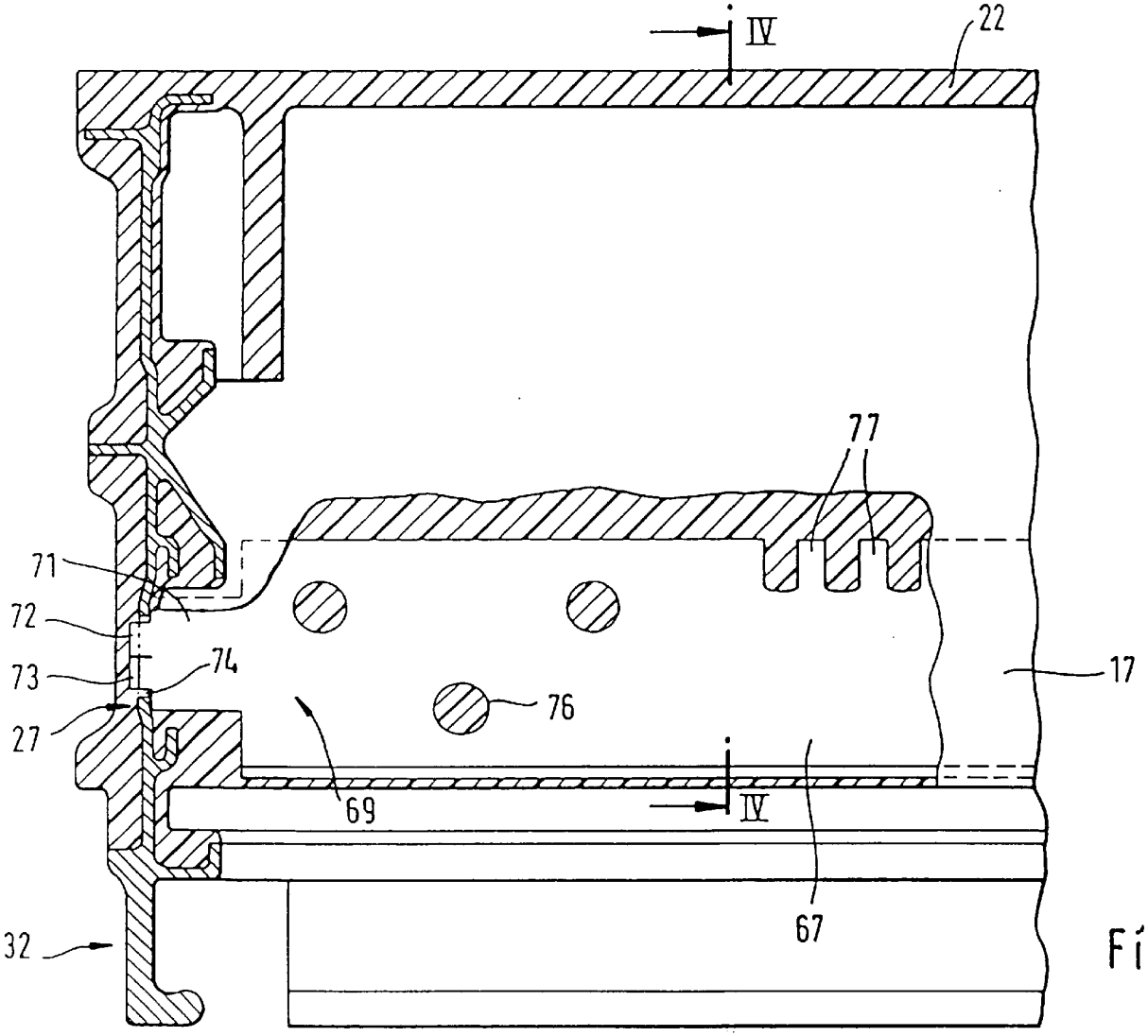
FIG. 3 shows a schematic partial section along the line III—III in FIG. 1, with a schematic partial section of a transverse web.
Figure 5:
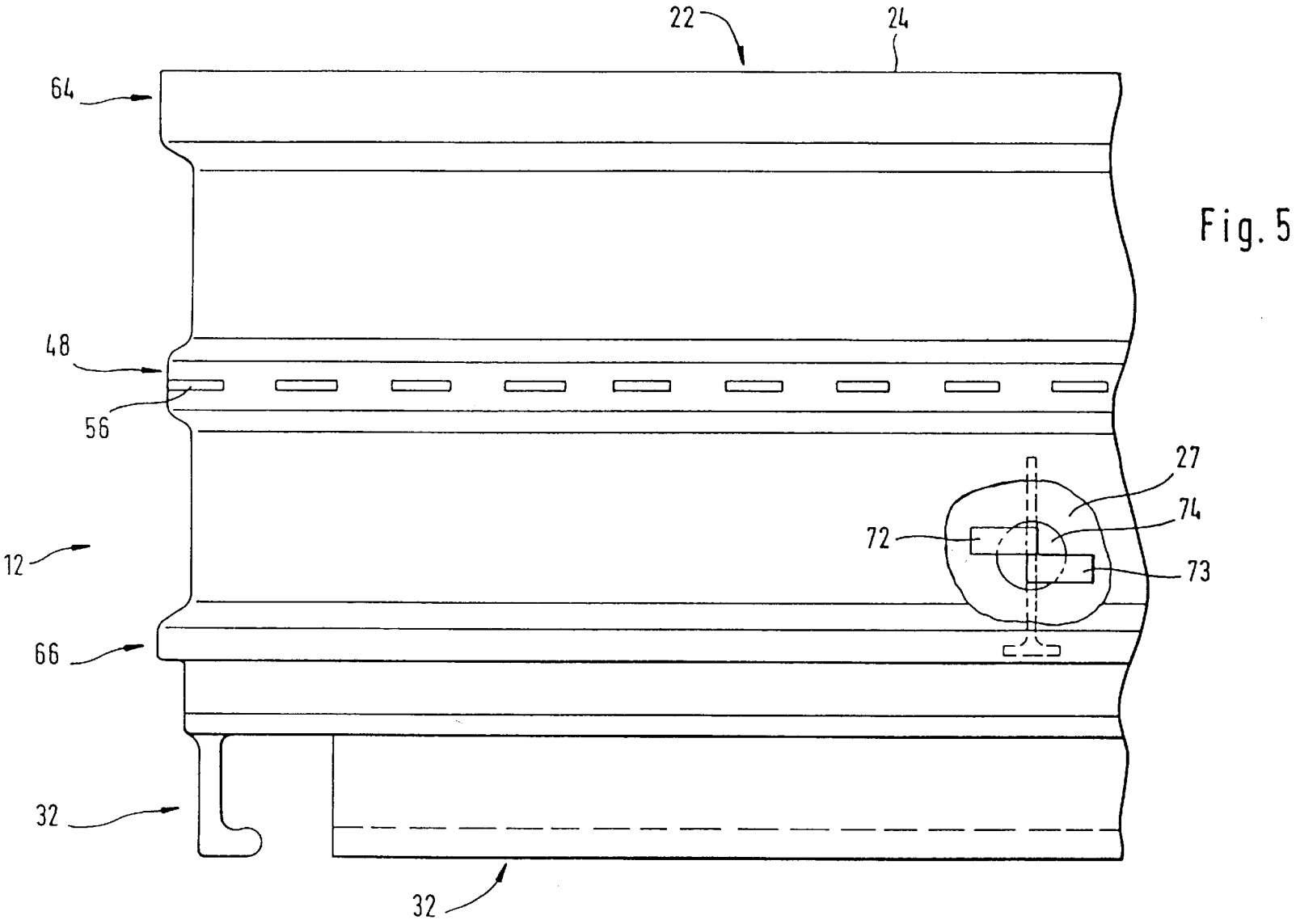
FIG. 5 shows a schematic side view of a corner region of the shuttering member.

A schematic partial section along the line III—III according to FIG. 1 is shown in FIG. 3. The partial section shows the arrangement of the transverse web 17 with respect to the beam profile 27, and also its embodiment. According to the sectional diagram along the line IV—IV in FIG. 4, the transverse web 17 has a T-profile 67 which ends with a transverse web 68 at a lower end. The transverse web 17 is completely embedded in plastic. This T-profile 67 is likewise constituted as an extruded profile of aluminum or an aluminum alloy. A projection 71 which is tapered with respect to the width of the T-profile 67 is formed at the end 69 facing toward the beam profile 27, and has at its free end two lugs 72 and 73 which engage in a bore 74 of the beam profile 27. The bore 74 is provided in the region of the offset 47. For fixing, the lugs 72, 73 are bent in opposite directions (FIG. 5), whereby the transverse web 17 is fixed in its position relative to the beam profile 22. The transverse web 17 extends from the shuttering panel 22 to below the transverse web 68 of the T-profile 67.

Several bores 76 are provided, seen in the longitudinal direction of the T-profile 67, so that a bridge or connection can be formed between a plastic wall formed left and right of the T-profile 67. The bores 76 are provided at regular spacings and mutually offset in a V-pattern. Furthermore, two fingers 77 are provided at regular spacings, at an upper edge region of the T-shaped profile, and are deflected in opposite directions out of the longitudinal plane of the T-profile 67. The maintenance of a spacing for the T-profile in the injection mold can thereby be produced. This can alternatively take place by setting a plastic clip or the like on a finger 77 of the T-profile 67.

In the final state, the lug connection between the transverse web 17 and the beam profile 27 and also the transverse web 17 have plastic injection molded completely around them. Alternatively, simply and rapidly mounted connections are provided between the transverse web 17 and the beam profile 27.

The transverse webs 17 can furthermore have an opening which is constituted as a handle opening. Alternatively, it can be provided that a handle can be arranged in this opening, so as to provide for easy handling of the shuttering members 12, 13.

Figure 6:
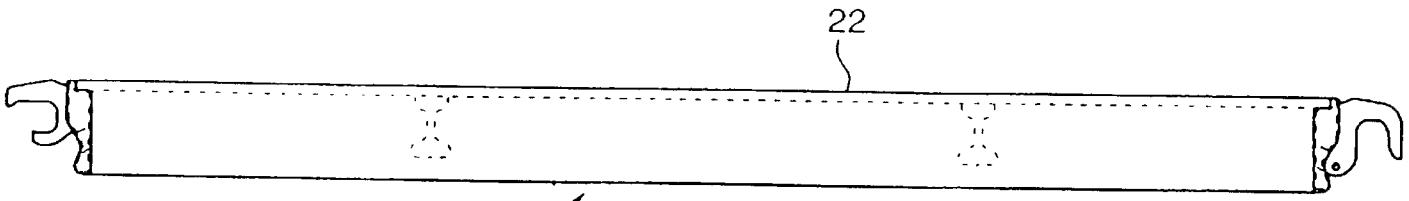
FIG. 6 shows a side view of a structural member constituted as a scaffold flooring.
Figure 7:
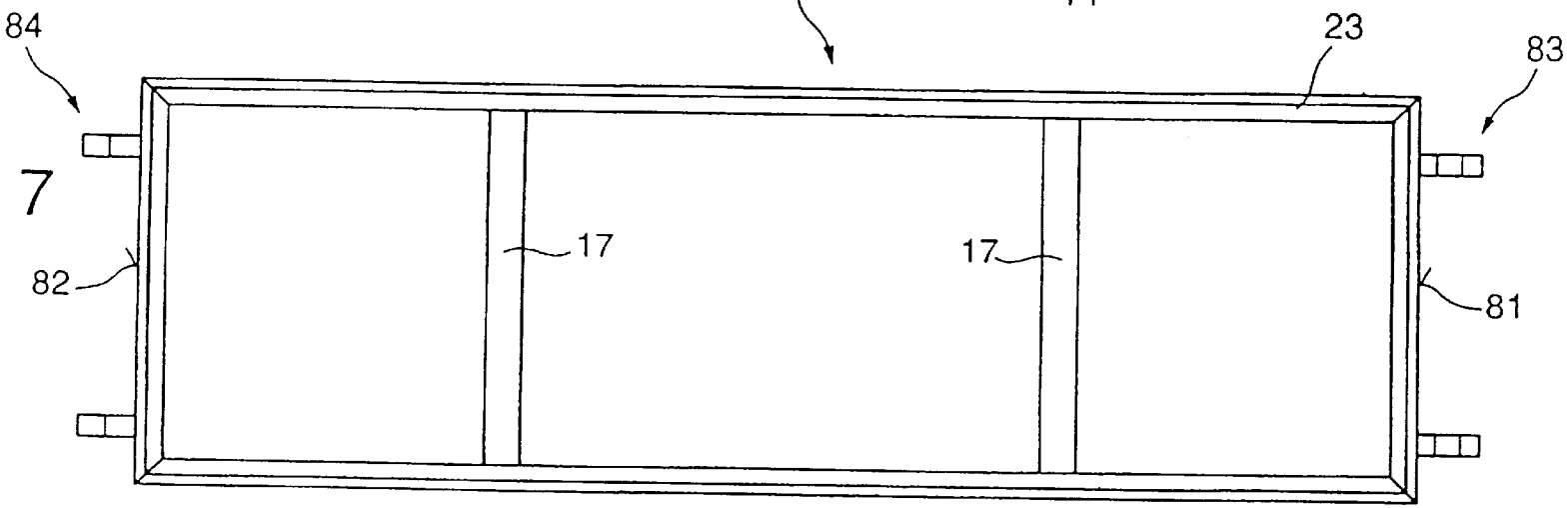
FIG. 7 shows a view from below of the structural member according to FIG. 6.
Figure 8:
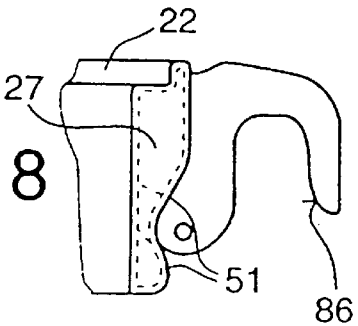
FIG. 8 shows a schematic, enlarged detail view of a fastening element.

FIG. 6 shows a side view of a structural member constituted as a scaffold flooring 80. The scaffold flooring 80 has a structural frame 14 which carries the working surface 22 and which is arranged perpendicular to the working surface 22. The structural frame 14 constitutes frame members 23 which surround the working surface 22. The function and the structure of the scaffold flooring 80 as shown in FIGS. 6–9 corresponds to the shuttering members 12, 13.

It is provided that fastening elements 83, 84 are installed on the narrow end sides 81, 82 in the scaffold flooring 80, in order to fasten the scaffold flooring 80 to a scaffold, preferably a frame scaffold. Such scaffolds are particularly used for plastering, painting, or the like of facades. The fastening elements 83 are constituted as suspension hooks as schematically shown in the enlarged side view of FIG. 8. The hooking member 83 is fastened to the beam profile 27, for example by welding, clamping, adhesion, or the like. The scaffold flooring 80 can be inserted in a simple manner from above in a horizontal pipe (not shown).

The beam profiles 27 in this embodiment are advantageously constituted as hollow chamber profiles. This can also be the case for the shuttering members 12, 13. The embedding with injected plastic can take place, in the arrangement as hollow chamber profiles, analogously to the arrangement according to the beam profiles 27 of the shuttering members 12, 13.

Figure 9:
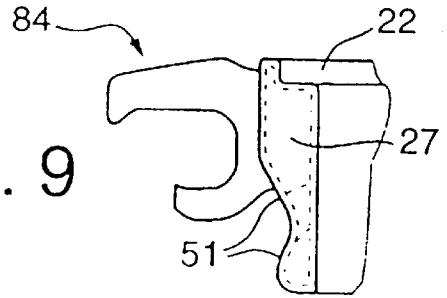
FIG. 9 shows a schematic, enlarged detail view of a fastening element constituted as a securement against lifting.

The fastening element 84 on the narrow side 82 is preferably constituted as a securement against lifting, as shown enlarged in FIG. 9. Increased safety during building operations can thereby be made possible. For mounting the scaffold flooring 80, there first takes place a setting of the securement against lifting 84 on horizontal tubes of the scaffold, in order then to lower the scaffold flooring into the horizontal plane, whereupon the fastening element 83 likewise engages a horizontal tube of the scaffold. The lead-in slant 86 can preferably used for this.

It can alternatively be provided that hooking elements are provided as the fastening element 83 on both ends 81, 82 of the scaffold flooring 80.

Horizontal transverse webs 17 are provided for stiffening the scaffold flooring 80, and are installed by means of a T-profile or other kind of profile if necessary. The beam profiles 27 have inclined surfaces 51 on their outer side. It can thereby be made possible that with several scaffold floorings arranged adjacent and parallel, a connection of the scaffold floorings 80 can be brought about by means of shuttering locks, so that a closed working surface 22 is constituted which can serve as a tread surface or storage surface.

It can furthermore be provided that the structural member in which the working surface 22 and the profile frame 14 are constituted integrally as an injection molded part is used as a working platform. The structural frame 14 can then be modified, for example, such that receptacles are installed which facilitate the fitting of brackets. In addition, further possibilities of fastening can be provided on the structural frame 14, in order to install thereon a railing which preferably can fold down.

The structural member according to the invention thus offers a basic concept for numerous embodiments which can be used not only in building operations.

The structural member according to the invention is produced by the process which is described hereinafter. The beam profiles 27 are cut to the corresponding measurements for length and width. The beam profiles 27 are assembled to a beam profile frame 46 by means of corner connecting elements 43. At the same time, transverse and middle webs 16, 17 are installed between the beam profiles 27 in dependence on the constructional size. The beam profile frame 47 thus represents a relatively rigid frame which however is constituted to be slightly resilient per se. This beam profile frame 46 is placed in a multi-part injection mold constituted with numerous gate valves. The injection mold is then closed, the end section 37 being arranged such that it forms a closure for the injection mold. A thermoplastic is introduced into the injection mold under a high pressure of, for example, 300–500 bar, via one of more injection locations which are preferably provided at the intersection points of the rib structure 18 or the middle and transverse webs 16, 17. The duration of injection for a shuttering member 13 of 160 cm by 40 cm takes about 6–8 seconds. After a small pressure equalization phase and a foaming of the plastic and a given cooling time, the finished shuttering member 12 can be taken from the injection mold.

The beam profile 27 is advantageously coated with an adhesion primer before the introduction of the thermoplastic, so that an adhesion of the plastic to the beam profile 27 over the whole surface is made possible.

Polypropylene is preferably used for the production of the shuttering member 12, 13, and is preferably filled with a glass fiber fraction of 5–40%, and furthermore is provided with a blowing agent which effects a foaming of preferably between 5 and 30%. Additives can also be admixed or applied as a cover layer, for example for UV resistance, for low water uptake, for good release from concrete, or the like. Alternatively, it can also be provided that polyamide or further thermoplastics can be used which have a high stiffness and low water uptake. The plastic is advantageously colored bright white to eggshell colors, so that the shuttering members 12, 13 take up no heat from solar radiation. It can alternatively be provided that the shuttering panel 22 has inlays for stiffening, which can preferably be given by metal or light metal inlay throughout or at least partially connectedly, or by a knitted or woven fabric. Furthermore it can alternatively be provided that, after the beam profile frame 46 has been placed in the injection mold, a shuttering panel with a sandwich structure, having two metal inlays to stiffen it, is placed in the injection mold and (these are) connected together by the subsequent injection of plastic, to give a shuttering member 12, 13.

It can furthermore be provided that a coating is placed in the mold, so that the shuttering member 12, 13 is identifiable by the coating provided on the shuttering panel 22. Thus the shuttering panel 22 or the front side 24 can simultaneously serve as an advertising surface.

The middle web 16 can be constituted analogously to the cross section 17. Likewise, an analogous fastening can be provided at its intersection points. The structure and the arrangement of the members 12, 13 described hereinabove is not limited only to shuttering members, but can be used for all further supporting systems in which the creep of the plastic represents a considerable obstacle which can be compensated for by means of metallic reinforcements or plastic reinforcements, such as for example by the beam profiles. Such supporting systems can be, for example, doors, cassettes, roof coverings, shaped parts in motor vehicle construction, roof panels and also emergency accommodations.

I claim:

1. A structural member comprising a working surface (22), a profile frame (14) that supports the working surface (22) and is arranged perpendicular to the working surface (22) and has at least one frame member (23) forming the profile frame (14), the at least one frame member (23) comprising:

a beam profile (27) that is at least partially embedded in injection molded plastic, an upper section (31) that includes a portion of the beam profile (27) that is embedded in injection molded plastic immediately adjoining the working surface (22) and at least one internal free abutment surface (50) of the beam profile (27), and a lower section (29) that is not embedded in plastic, including an abutment surface (34) that is arranged substantially at right angles to the system plane (28) of the frame member (23) and a foot (32) extending along the system plane (28), the working surface (22) and the at least one frame member (23) being formed integrally as an injection molded part, and the free abutment surface (50) of the beam profile (27) being arranged at an angle that is not parallel to the system plane (28).

2. The structural member according to claim 1, in which the working surface (22) comprises a shuttering panel and the structural member is a shuttering member for a wall shuttering or ceiling shuttering.

3. The structural member according to claim 1, in which the working surface (22) comprises a tread surface and the structural member comprises a scaffold flooring for scaffolds.

4. The structural member according to claim 3, in which the structural member comprises a scaffold flooring for frame scaffolds.

5. The structural member according to claim 3, further comprising fastening elements (84, 86) on at least at two mutually opposed sides of the working surface (22).

6. The structural member according to claim 5, in which the fastening element (84) on one side comprises a hooking element, and the fastening element on an opposed side comprises a securement against lifting (86).

7. The structural member according to claim 1, in which the beam profile (27) and a plastic portion of the working surface (22) and the structural frame (14) provide substantially the same load bearing capacity.

8. The structural member according to claim 1, in which the load bearing capacity of the structural member amounts to up to about 60 $kN/m^2$.

9. The structural member according to claim 1, in which the foot is L-shaped.

10. The structural member according to claim 1, in which the frame member (23) has on its outer surface first and second abutment surfaces (62, 65) which stand out opposite a side wall and which form an abutment surface for a further frame member of a ceiling or wall shuttering.

11. The structural member according to claim 10, in which the first abutment surface (62) adjoins an edge (61) bounding the working surface (22) and the second abutment surface (65) comprises a projection (66) that is arranged near a lower section (29) of the frame member (23).

12. The structural member according to claim 11, in which the first and second abutment surfaces (62, 65) have between them substantially two webs (51, 52) for receiving a claw of a shuttering lock (19) in a middle region of the frame member (23).

13. The structural member according to claim 12, in which the two webs are mutually arranged in a V-shape.

14. The structural member according to claim 1, in which at least one plurality of middle webs (16) and transverse webs (17) are provided between the frame members (23) and comprise a profile (67) that is embedded in injection molded plastic.

15. The structural member according to claim 14, in which the profile (67) is T-shaped.

16. The structural member according to claim 14, in which the profile (67) has a free end (69) with a projection (71) with connecting elements (72, 73) for connection to the beam profile (27).

17. The structural member according to claim 16, in which the connecting elements (72, 73) comprise lugs that engage in a bore (74) of the beam profile (27) and are bent around opposite to each other.

18. The structural member according to claim 14, in which a rib structure (18) is provided between the middle webs (16) and transverse webs (17) and is comprised of plastic.

19. The structural member according to claim 18, in which the rib structure (18) consists of an arrangement selected from a star shape to intersection points between the middle webs (16) and transverse webs (17), along diagonals between middle webs (16) and the frame member (23), in a honeycomb form, and in a polygonal form.

20. The structural member according to claim 19, further comprising an anchor pocket (21) between the frame member (23) and the rib structure (18) to receive anchor bars.

21. The structural member according to claim 18, in which the middle webs and transverse webs (16, 17) are wider than the rib structure (18) arranged between them.

22. The structural member according to claim 18, in which the middle webs have different widths than the transverse webs.

23. The structural member according to claim 22, in which the transverse webs (17) are wider than the middle webs (16).

24. The structural member according to claim 18, in which the working surface (22) has a wall thickness that is greater or equal to at least one of the thickness of the middle webs, the transverse webs and the rib structure (18).

25. The structural member according to claim 14, in which an opening is provided on at least one of the middle webs (16) and transverse webs (17), and comprises a handle, or receives a handle inserted in the opening.

26. The structural member according to claim 1, in which a plurality of beam profiles (27) extend along the frame members (23) of the profile frame (14).

27. The structural member according to claim 1, in which the frame member (23) includes a further internal abutment surface (53) at a free end of the frame member (23).

28. The structural member according to claim 1, in which a plurality of beam profiles (27) are connected together with at least one corner connecting element (43) to form a beam profile frame (46).

29. The structural member according to claim 28, in which the beam profiles (27) and the corner connecting element (43) are connected together by at least one of a plug connection, clamp connection, and latch connection.

30. The structural member according to claim 28, in which the corner connecting element (43) is inserted in a claw catch formed by guide grooves (41, 42), of the beam profile (27).

31. The structural member according to claim 1, in which the injection molded part comprises an impact resistant polymer material.

32. The structural member according to claim 31, in which the polymer material is polypropylene or polyamide.

33. The structural member according to claim 31, in which the polymer material is filled with at least 5% glass fiber.

34. The structural member according to claim 31, in which the polymer material is foamed to an extent of at least 5%.

35. The structural member according to claim 31, in which the polymer material is filled or coated with at least one of weather resistant, UV resistant, and concrete deflecting additive.

36. The structural member according to claim 31, in which the polymer material is colored in a range of white to eggshell color.

37. The structural member according to claim 1, in which a cross sectional surface of the beam profile (27) runs along the system plane (28) of the frame member, and the beam profile (27) has an upper section (31) around which plastic is injection molded that includes a plurality of sections (38, 39, 41, 42, 51, 52, 54, 58, 59) and a lower section (29) that is not embedded in injection molded plastic, with a foot (32).

38. The structural member according to claim 37, in which the lower and upper sections (29, 31) of the beam profile (27) are separated by an end section (37).

39. The structural member according to claim 38, in which the end section (37) has a right arm (38) that is L-shaped and has an abutment surface (53) that runs parallel to the system plane (28).

40. The structural member according to claim 38, in which the end section (37) has an outward projection (39) whose outward extension substantially corresponds to an outwardly situated plastic wall thickness of the frame member (23).

41. The structural member according to claim 38, further comprising a lower and an upper guide groove (41, 42) above the end section (37).

42. The structural member according to claim 41, in which an offset (47) is provided between the lower and upper guide grooves (41, 42).

43. The structural member according to claim 42, in which the offset (47) has bores spaced apart.

44. The structural member according to claim 43, in which the bores are regularly spaced apart from each other along the offset (47).

45. The structural member according to claim 38, in which the upper section (31) has an end region (49) with at least two profile webs (58, 59) which face in opposite directions and are arranged substantially at right angles to the system plane (28).

46. The structural member according to claim 45, in which the end section (37) and the end region (49) of the upper section (31) each have a thickening.

47. The structural member according to claim 37, in which the foot (32) is L-shaped and has an abutment surface (34) on the underside of the foot.

48. The structural member according to claim 47, further comprising an offset (47) formed between a middle section (48) and an end region (49) of the upper section (31).

49. The structural member according to claim 48, in which bores are regularly spaced apart from each other in a longitudinal direction on the offset.

50. The structural member according to claim 37, further comprising two webs (51) that are substantially arranged mutually in a V-shape and form a reinforcing crease in a middle region (48) of the upper section (31), the two webs (51) having end sections (52) running substantially parallel to the system plane (28).

51. The structural member according to claim 50, further comprising a web (54) running substantially at right angles to the system plane (28) and arranged opposite a base formed by the two webs (51) arranged mutually in a V-shape.

52. The structural member according to claim 51, in which the web (54) is sectionally interrupted seen in the longitudinal direction of the web (54).

53. The structural member according to claim 37, in which webs (38, 39, 51, 52, 54, 58, 59) extend left and right of the system plane (28) and end in a respective plane parallel to the system plane (28).

54. The structural member according to claim 37, in which the beam profile (27) is an extruded profile.

55. The structural member according to claim 37, in which the beam profile (27) is a rolled profile.

56. The structural member according to claim 37, in which the beam profile (27) is comprised of light metal.

57. The structural member according to claim 37, in which the beam profile (27) is comprised of aluminum or an aluminum alloy.

58. The structural member according to claim 37, in which the beam profile (27) is comprised of metal.

59. The structural member according to claim 37, in which the beam profile (27) is comprised of plastic.

60. The structural element according to claim 59, in which the plastic comprises reinforced plastic.

61. The structural member according to claim 59, in which the plastic comprises fiber reinforced or fabric reinforced plastic.

62. The structural member according to claim 1, in which at least an upper section (31) of the beam profile (27) has an adhesion primer.

63. The structural member according to claim 1, in which the beam profile (27) is plastically or elastically preformed.

64. The structural member according to claim 63, in which the beam profile (27) is preformed in the direction of a principal axis of the beam profile (27).

65. The structural member according to claim 63, in which the working surface comprises a shuttering panel, further comprising a surface midpoint situated in the working surface and raised with respect to the edges of the shuttering panel.

66. The structural member according to claim 1, in which the beam profile (27) is deformed with a tool control after being placed in an injection mold.

67. The structural member according to claim 1, in which the beam profile (27) comprises at least partially a hollow chamber profile.

68. A process for the production of a structural member (12) having a working surface (22), a profile frame (14) that supports the working surface (22) arranged perpendicular to the working surface (22), and at least one frame member (23) having a beam profile (27) that is at least partially embedded in injection molded plastic forming the profile frame (14), in which the working surface (22) and the profile frame (14) are formed integrally as an injection molded part and at least one transverse web (17) is provided between the frame members, comprising:

cutting at least one beam profile (27) and at least one transverse web (17) to size, placing the beam profile (27) and transverse web (17) arranged thereon in an injection mold, and producing in one injection process a structural member (12) having a working surface (22) and a profile frame (14) running on the outside of the structural element and having frame members (23) running perpendicular to the working surface (22) formed by beam profiles (27) that are partially embedded in injection molded plastic.

69. The process according to claim 68, further comprising forming a beam profile frame (46) of beam profiles (27), by corner connecting elements (43), and placing the beam profile frame in the injection mold.

70. The process according to claim 69, in which the beam profile frame comprises a resilient frame.

71. The process according to claim 68, further comprising placing at least one inlay that reinforces the working surface (22) in the injection mold prior to the injection process.

72. The process according to claim 71, in which the inlay is selected from a metallic or nonmetallic foil or lattice, woven fabric and knitted fabric.

73. The process according to claim 68, in which the working surface comprises a shuttering panel (22), further comprising placing a prefabricated shuttering panel (22) in the injection mold and at least partially embedding the prefabricated shuttering panel (22) in injection molded plastic.

74. The process according to claim 73, in which the prefabricated shuttering panel (22) comprises a sandwich structure with stiffenings.

75. The process according to claim 68, further comprising producing the structural element (12) with a length of up to 300 cm and a width of up to 125 cm in the injection molding process within less than 10 seconds.

76. The process according to claim 68, further comprising providing injection points by means of which polymer material is injected between intersection points of transverse webs (17) and middle webs (16) of the structural member (12).

77. The process according to claim 68, further comprising providing injection points in the structural member (12) with a width of 40 cm, by which polymer material is injected in intersection points of a rib structure (18) of the structural member (12).

* * * * *